US009277810B2

(12) United States Patent
Symonds et al.

(10) Patent No.: US 9,277,810 B2
(45) Date of Patent: Mar. 8, 2016

(54) TRADING DESK

(71) Applicant: S.B.F.I. Limited, London (GB)

(72) Inventors: Steven Glen Symonds, Hurstpierpoint (GB); Andrew Timothy Edwards, Bolnore Village (GB)

( * ) Notice: Subject to any disclaimer, the term of this patent is extended or adjusted under 35 U.S.C. 154(b) by 0 days.

(21) Appl. No.: 14/276,048

(22) Filed: May 13, 2014

(65) Prior Publication Data

US 2015/0327671 A1 Nov. 19, 2015

(51) Int. Cl.

| | |
|---|---|
| ***A47B 37/00*** | (2006.01) |
| ***A47B 21/04*** | (2006.01) |
| ***A47B 21/02*** | (2006.01) |
| ***A47B 21/06*** | (2006.01) |
| ***A47B 13/02*** | (2006.01) |

(52) U.S. Cl.

CPC ..... *A47B 21/04* (2013.01); *A47B 13/02* (2013.01); *A47B 21/02* (2013.01); *A47B 21/06* (2013.01)

(58) Field of Classification Search

CPC .... A47B 47/03; A47B 87/0284; H05K 7/186; H02B 1/014; H02B 1/301

See application file for complete search history.

(56) References Cited

U.S. PATENT DOCUMENTS

| | | | | | |
|---|---|---|---|---|---|
| 3,525,560 | A | * | 8/1970 | Mac-Farlane et al. | 312/265.3 |
| 4,755,009 | A | * | 7/1988 | Price et al. | 361/679.08 |
| 4,836,625 | A | * | 6/1989 | Catta | 312/265.1 |
| 4,920,458 | A | * | 4/1990 | Jones | 362/33 |
| 5,174,223 | A | | 12/1992 | Nagy et al. | |
| 5,224,429 | A | * | 7/1993 | Borgman et al. | 108/147 |
| 5,499,868 | A | * | 3/1996 | Schainholz | 312/236 |
| 5,522,324 | A | * | 6/1996 | van Gelder et al. | 108/50.02 |
| 5,609,402 | A | * | 3/1997 | Kemp | 312/265.4 |
| 5,881,500 | A | * | 3/1999 | Latino et al. | 52/36.1 |
| 5,975,657 | A | * | 11/1999 | LaCour | 312/196 |
| 6,050,659 | A | * | 4/2000 | LaCour | 312/223.3 |
| 6,076,903 | A | * | 6/2000 | Vander Park | 312/196 |
| D443,157 | S | * | 6/2001 | Linder | D6/509 |
| 6,283,043 | B1 | * | 9/2001 | Stern et al. | 108/50.02 |
| 6,374,752 | B1 | | 4/2002 | Walser | |
| 6,382,747 | B1 | * | 5/2002 | Catta et al. | 312/257.1 |
| 6,990,909 | B2 | * | 1/2006 | Gosling et al. | 108/50.02 |
| 7,249,741 | B1 | | 7/2007 | Larson | |
| 7,478,819 | B1 | | 1/2009 | Boraas et al. | |
| 7,762,566 | B2 | | 7/2010 | Wang | |
| 2011/0001406 | A1 | * | 1/2011 | Han et al. | 312/236 |

FOREIGN PATENT DOCUMENTS

| | | | |
|---|---|---|---|
| EP | 0058535 | A2 | 8/1982 |
| EP | 0563850 | A1 | 10/1993 |
| GB | 2395113 | B | 6/2005 |
| GB | 2482743 | A | 2/2012 |
| GB | 2507076 | A | 4/2014 |
| JP | 4148409 | B2 | 9/2008 |
| WO | 2008/054427 | A1 | 5/2008 |

* cited by examiner

*Primary Examiner* — Hanh V Tran

(74) *Attorney, Agent, or Firm* — The Van Winkle Law Firm; David M. Carter

(57) ABSTRACT

A frame for a trading desk is made up of two end frames arranged to extend vertically in use. Between those end frames there is a main support beam structure which may include a pair of main structural beams for example. The main support beam may be extended from a lower part of the end frames, close to the floor and provides the main structural rigidity of the desk. A computer trolley is provided which supports computers just above the main support beam and has a channel arranged to receive the main support beam.

13 Claims, 8 Drawing Sheets

TRADING DESK

BACKGROUND OF THE INVENTION

This invention relates to desks, in particular desks known in the art as "trading desks," which are used for example in the trading rooms of banks. However, trading desks can be, and are, used in other industries which have similar requirements in particular in relation to capacity for large numbers of powerful PCs and screens.

Trading desks differ from normal office desks because of the environment in which they are used; typically on the trading floors of banks. This environment calls for good use of space in order to accommodate staff as efficiently as possible and the ability to mount large numbers of computers beneath the desktop and large numbers of screens above the desktop. A typical 1500 mm wide desk would be expected to accommodate up to 7 high performance PCs and would be expected to carry upwards of 6 flat-screen monitors, typically 2-12 monitors are mounted in a trading environment. Typically such desks will be set side-by-side in rows along a room and as such the depth of the trading desk will define the number of rows that can be accommodated.

Other environments in which trading desks are used include control rooms (for example in power stations and police call centres) and the offices of visual effects providers.

A typical frame structure for a trading desk is disclosed in GB2395113. It can be seen that the prior art desk is made up of a main beam structure which provides stability, a pair of end structures comprising arms connected to the beam structure and a pair of legs depending from the arms of each of the end structures remote from the main beam structure; in use a desktop is fitted onto the end structures. This "goalpost" construction, in which the main support beam is situated roughly at the top of the legs, attached to the tops of the legs by an end structure is very useful in providing a solid and stable desk.

Furthermore, telescopic legs supporting the desktop are also often provided, so that the desktop can be raised and lowered. This has led to a structure as shown in FIGS. 1-3 in which the end frames are effectively integrated with the legs of the desk and have only small feet depending from them. The telescopic legs carrying the desktops can then be mounted in the end frames. In order to provide sufficient stability for the desk instead of a single main support beam, the main beam structure comprises a pair of parallel plinth beams spanning the top corners of the end frames, once again forming a "goalpost" construction. As FIG. 2 shows, an equipment tray for carrying power cables and the like is situated between the plinth beams and as shown in FIG. 1, doors can be provided on the end frames, to close off the area underneath the equipment trays, in which computers, on trolleys will be situated.

With desks of this sort, typically it is possible to lower a desktop to 720 mm and raise it to 1395 mm. The lower limit is defined by the height of the top of the main beam structure, which the lower surface of the desktop abuts; in turn, the height of the main beam structure is defined by the height of PCs (and the trolleys that carry them), because these are situated beneath the main beam.

However, particularly in view of recent European Standard EN527-1:2011 it is considered desirable to be able to lower the desktop further, to 650 mm. It is also desirable to provide legroom depth on the floor (and up to 120 mm above the floor) of at least 800 mm. The increase in legroom could be easily achieved by providing deeper desktops, but that would of course conflict with the desirability to keep the depth of the desks as small as possible in order to accommodate the maximum number of rows of desks.

SUMMARY OF THE INVENTION

Against this background, in one aspect of the invention, there is provided a desk, having a main support beam wherein in use the upper surface of the main support beam can be situated no more than 120 mm above the base of the trading. Preferably the desk is a trading desk.

A second aspect of the invention provides frame for a trading desk comprising two end frames arranged to extend vertically in use and a main support beam which in use extends laterally between the end frames; characterised in that the main support beam is adapted to extend from a lower part of the end frames, in use.

The counter-instinctive provision of the support frame in the lower region of the frame/trading desk, in the region where a trolley is normally provided to support computers beneath the desk results in a saving of space in the upper region of the trading desk. This is the region where a plinth beam would normally be positioned, and thereby allows the work surface to be positioned lower down, while still maintaining sufficient space below the desk for computers on computer-trollies to be stored beneath the desk. Despite the position near the bottom of the desk, the main support beam can provide sufficient stiffness that desktops which are positioned at a suitable height for working sitting down or standing up do not wobble excessively, even when the desks are used on the "floating floors" typically found in institutions that require trading desks.

Preferably a trading desk according to the first aspect of the invention comprises a frame according to the second aspect of the invention.

Preferably the end frames comprise panels or struts which extend vertically in use, and which are provided with feet; wherein in use the main support beam extends between the lower part of the panels or struts.

Preferably the end frames comprise legs.

Preferably each end frame comprises a plurality of legs, with a brace extending between the lower parts of the legs and the main support beam is adapted to be connected to the brace.

Preferably the main support beam is movably supported by the end frames, such that the height of the support beam can be adjusted.

Preferably the frame or desk further comprises sloping doors which, in use, slope outwardly from their bottom to their top.

Preferably the frame or desk further comprises a tray adapted to support cabling and the like below a desktop.

A third aspect of the invention provides a trolley for supporting computers, comprising a platform and a support, wherein the support defines a channel arranged to receive the main support beam of a frame or trading desk as defined above.

Such a trolley fits around the beam but owing to the shape of its support which defines a channel does not compromise the toe space for a user.

Preferably the channel is defined by a U-shaped support.

Preferably the channel is defined by an H shaped support.

Preferably the trolley comprises a plurality of supports at least one of which is U-shaped.

Preferably the trolley comprises a plurality of supports at least one of which is H-shaped.

Preferably the trolley has casters depending from the support.

In a preferred aspect of the invention the frame or trading desk as defined above is provided in combination with a trolley as defined above.

In a fourth aspect of the invention, there is provided a kit of parts for building a trading desk comprising two end frames intended to extend vertically in use, a desktop intended to be supported by the end frames and a main support beam intended to extend laterally between the end frames; characterised in that the end frames are provided means for supporting the desktop at one end and with fastening means for attaching the main support beams at the opposite end.

BRIEF DESCRIPTION OF THE DRAWINGS

In order to more fully understand the invention and certain preferred aspects thereof, an embodiment is described below with reference to the accompanying drawings in which.

DESCRIPTION OF THE PREFERRED EMBODIMENTS

Figure 4:
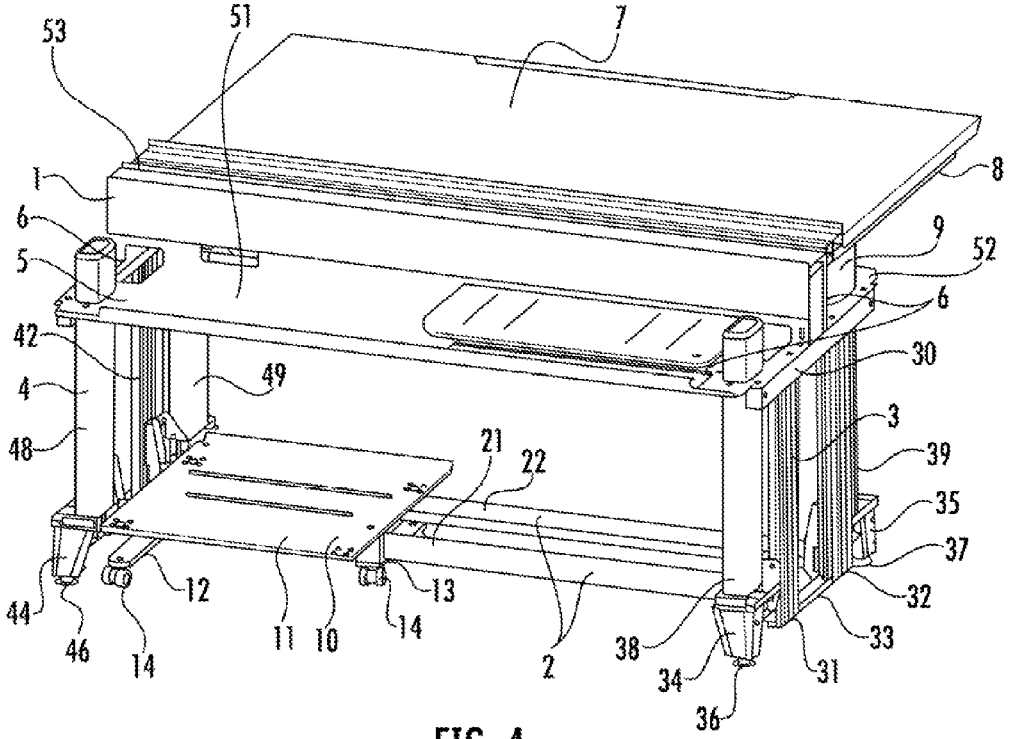
FIG. 4 shows a perspective view of the frame of a trading desk according to the present invention.

With reference to FIG. 4, a frame 1 for a trading desk, includes a main support beam structure 2 in the form of first and second parallel beams 21, 22 which are horizontal and extend laterally across the breadth of the trading desk. The main structural beams 21, 22 are shown to be mounted close to the floor, towards the base of the frame 1. The main structural beams 21, 22 maintain the rigidity of the desk and must be made from an appropriate material, such as 3 mm thick box-section mild steel.

One end of each main structural beam 21, 22 is connected on one side to a first end frame 3 and at the other end to a second end frame 4. By contrast to the main structural beams, the end frames may be formed by thinner gauge extruded aluminium (for example).

The first end frame, 3 comprises a pair of vertically extending struts 31, 32, such that the first main structural beam 21 is connected at its right hand end near the bottom of the first vertically extending strut 31; the second main structural beam 22 is connected at its right hand side to the second vertically extending strut 32. The first vertically extending strut 31 is braced apart from the second vertically extending strut 32 by a bracer 33, which in this case is situated towards the lower end of the vertically extending struts 31, 32. To the outside of each vertically extending strut 31, 32, legs 34 and 35 are connected, each terminating with an adjustable foot 36, 37. Between the first vertically extending strut 31 and the first leg 34 a first tubular mount 38 for a telescopic desk support is provided. Likewise, outwardly of the second vertically extending strut 32, but inwardly of the second leg 35, a second tubular mount 39 for a telescopic desk support is provided. At the top of the first end frame 3, a bar 30 is provided. The bar connects, and braces, the vertical struts 31, 32 and the tubular mounts 38, 39.

The second end frame, 4 is effectively a mirror image of the first end frame 3 and comprises a pair of vertically extending struts 41, 42, such that the first main structural beam 21 is connected at its left hand end near the bottom of the first vertically extending strut 41; the second main structural beam 22 is connected at its left hand side to the second vertically extending strut 42. The first vertically extending strut 41 is braced apart from the second vertically extending strut 42 by a bracer 43 (not shown in FIG. 4). To the outside of each vertically extending strut 41, 42, legs 44 and 45 (not shown in FIG. 4) are connected, each terminating with an adjustable foot 46, 47 (not shown in FIG. 4). Between the first vertically extending strut 41 of the second end frame 4 and the first leg 44 a first tubular mount 48 for a telescopic desk support is provided. Likewise, outwardly of the second vertically extending strut 42 of the second end frame 4, but inwardly of the second leg 45, a second tubular mount 49 for a telescopic desk support is provided. At the top of the second end frame 4, a bar 40 is provided. The bar connects, and braces, the vertical struts 41, 42 and the tubular mounts 48, 49.

A tray 5, which can be of thin metal construction, extends horizontally between the top of the first end frame 3 and the top of the second end frame 4. In this embodiment rather than a single tray, the tray 5 is composed of a first tray portion 51 and second tray portion 52. The first tray portion 51 extends between the first bar 30 and the second bar 40 in the region of the tops of the first vertically extending struts 31, 41, of each of the first and second end frames 3, 4. Likewise the second tray portion 52 extends between the first bar 30 and the second bar 40 in the region of the tops of the second vertically extending struts 32, 42 of each of the first and second end frames 3, 4. Although the main support beams 21, 22 provide the main strength to the frame by bracing the end frames apart, the tray 5 also provides additional stability by acting against any force pushing the first bar 30 of the first end frame 3 towards or away from the second bar 40 of the second end frame 4.

The tray 5 provides a support for cables and the like and is provided with apertures 6 through which cables may extend, in use. The flat surfaces of the tray portions 51, 52 in this embodiment are situated no more than 650 mm above the base of the feet 36, 37, 46, 47. However, at the central region, between the first tray portion 51 and the second tray portion 52 the tray 5 extends upwardly to a slatted upper surface 53, through which arms (not shown) for monitors (not shown) can extend and through which heat from computers (not shown) can escape.

The frame of this embodiment is intended to provide two work-surfaces (one of which is shown in FIG. 4) opposite one another. Thus a first desktop 7 is mounted via supporting arms 8 onto telescopic legs 9 situated in the rear corners of the desktop 7. The telescopic legs 9 are mounted in one tubular mount of each end frame 3, 4. Thus the desktop 7 is shown mounted in the second tubular mount 39 of the first end frame 3 and the second telescopic mount 49 of the second end frame 4. In use another desktop 7 (not shown) would be mounted via supporting arms 8 (not shown) and telescopic legs 9 (not shown) into the first tubular mounts 38, 48 of the first and second end frames 3, 4.

The desktops 7 of this embodiment are substantially rectangular, with their back ends parallel to one another in a central region of the trading desk, separated by the upwardly extending portion of the tray 5.

The telescopic legs 9 are arranged to be either manually cranked, lifted by gas struts or powered to lift the desktop between a lower position, in which the lower surface of the desktop is adjacent the top of the tray, at which point the work surface of the desktop is at about 650 mm to a height of up to about 1250 mm for use standing up. Of course the telescoping arrangement will allow for positioning at any point in between the lowest and the highest level.

Figure 5:
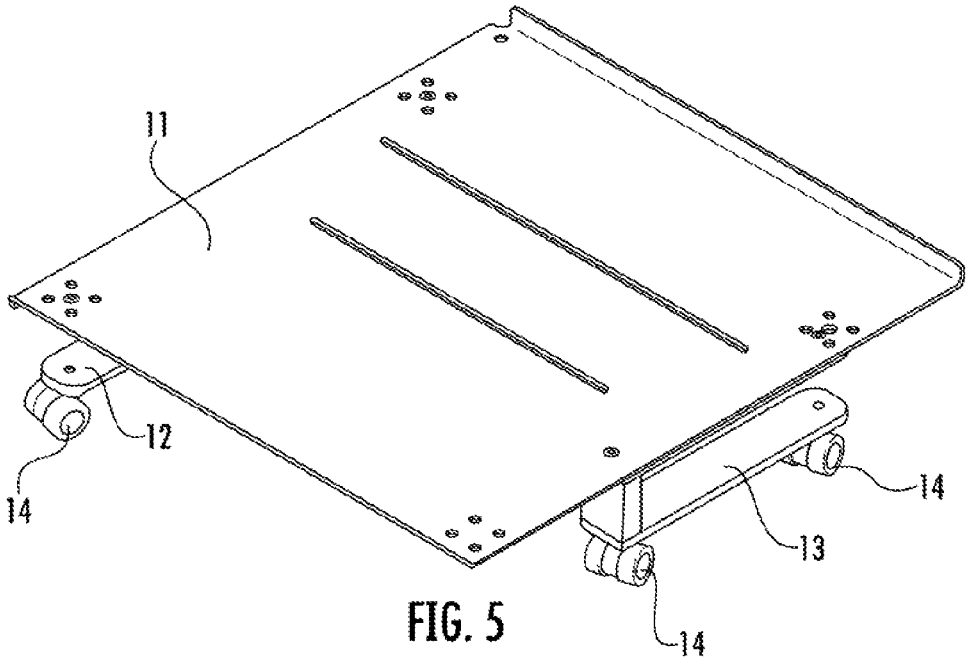
FIG. 5 shows a perspective view of a trolley according to the present invention.
Figure 6:
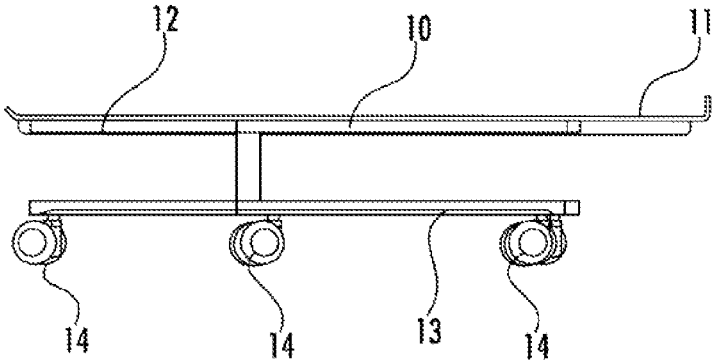
FIG. 6 shows a side view of the trolley of FIG. 5.

The trading desk 1 is also provided with a trolley 10 (shown in more detail in FIGS. 5 and 6) to support computers beneath the tray 5 of the desk. The trolley 10 is specially designed to co-operate with the main support beams 2 which are situated close to the base of the desk. The trolley 10 comprises a flat platform 11 on which computers can be placed which is arranged to be at least 120 mm above floor level, so that if someone with long legs is sitting at the trading desk 1 he/she can rest his/her feet beneath the platform 11. This leaves a height of around 530 mm in which to accommodate computers, seal off the top off the plinth (with the tray 5) and allow for the thickness of the desktop 7.

Figure 1:
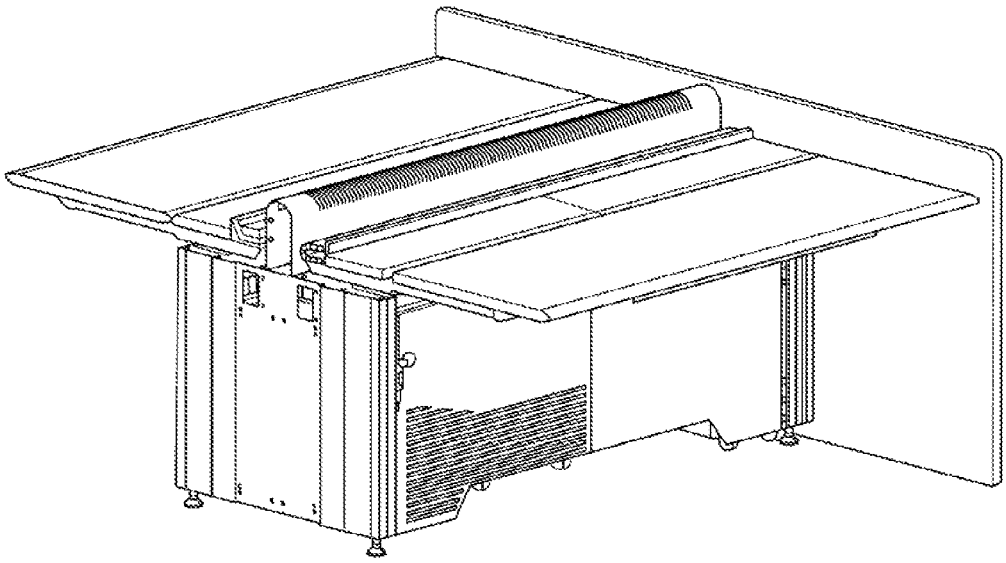
FIG. 1 (PRIOR ART)
FIG. 1 shows a perspective view of a prior art trading desk.
Figure 2:
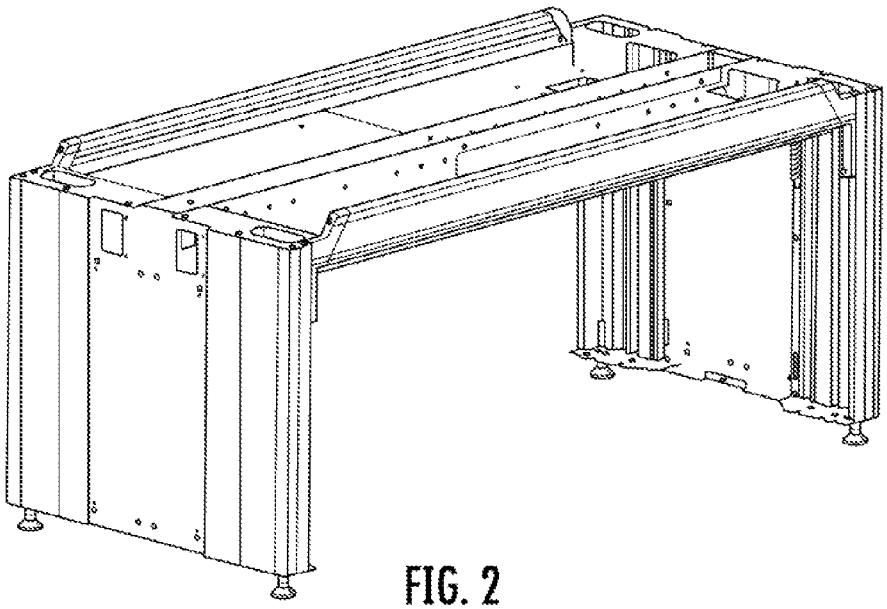
FIG. 2 (PRIOR ART)
FIG. 2 shows a perspective view of a frame for the prior art trading desk of FIG. 1.
Figure 3:
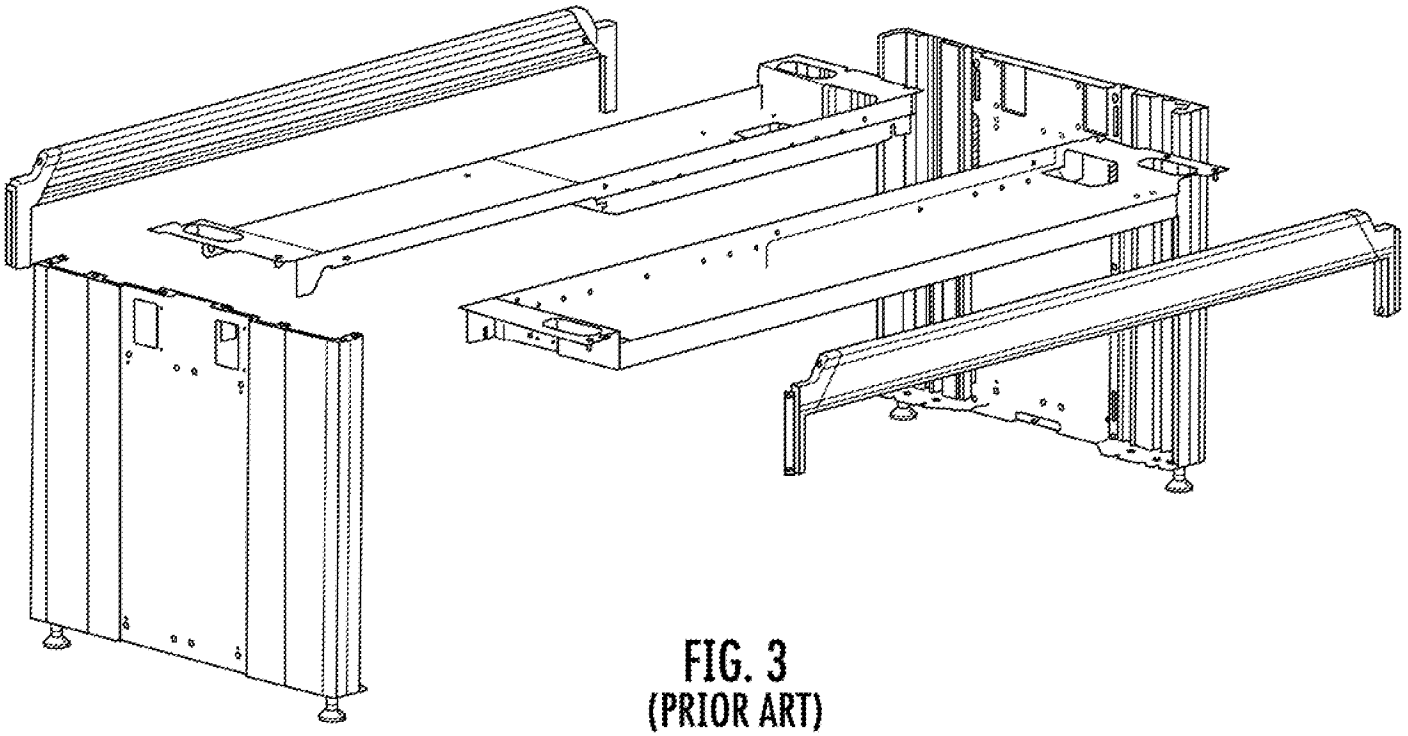
FIG. 3 (PRIOR ART)
FIG. 3 shows an exploded view of the frame of FIG. 2.

It will be appreciated that with a conventional trading desk as shown in FIGS. 1-3, because of the height of the plinth beams which provide the main support to the desk, if a height of 530 mm was allowed between the platform of the trolley (at 120 mm from the ground) and the bottom of the plinth beam, the lowest height of the desktop would be 650 mm plus the height of the plinth beam, typically this might be around 720 mm in total.

In order to co-operate with the main support beams 2, the flat platform 11 of the trolley 10 is mounted on special supports 12, 13, from which casters 14 depend. The trolley 10 extends approximately half way across the breadth of the desk, between the end frames 3, 4. Although only one trolley 10 is shown, in practice a pair would be provided. The first support 12 for the trolley 10 supports the side of the platform 11 which in use is positioned adjacent the end frame 4 (left hand side in FIGS. 4 and 5) and is H shaped, with a pair of horizontally extending webs separated by a link, so as to provide two opposing channels. The upper web of the H-shaped support is attached to the lower surface of the platform at the side adjacent the end frame 4 and the lower web is attached to a pair of casters 14 at each end. Because of the H-shape of the support and the fact that they are approximately the same length as the platform, casters 14 at the ends of the lower webs are positioned underneath two corners of the platform. The channel is of sufficient height to allow the upper web to pass over the upper surface of the main support beams 2, while the lower web passes under the main support beams 2. On the opposite side of the trolley 10 (right hand side in FIGS. 4 and 5), the second support 12 is attached to the underneath of the platform. In order to avoid causing an obstruction to a user's feet, the second support is U-shaped, thus defining just one channel between the webs, with the end of the channel defined by the link. The link is positioned inwardly away from the feet of a user, in use, and casters depend from the ends of the lower web so that both sides of the platform are supported. The U-shaped support has one caster 14 beneath the link and the other at the end of the lower web. The caster 14 at the end of the lower web is near a corner of the platform, and the caster 14 by the link is positioned inwardly of the end of the platform. The inwardly positioned caster 14 avoids obstructing the user's foot.

Figure 7:
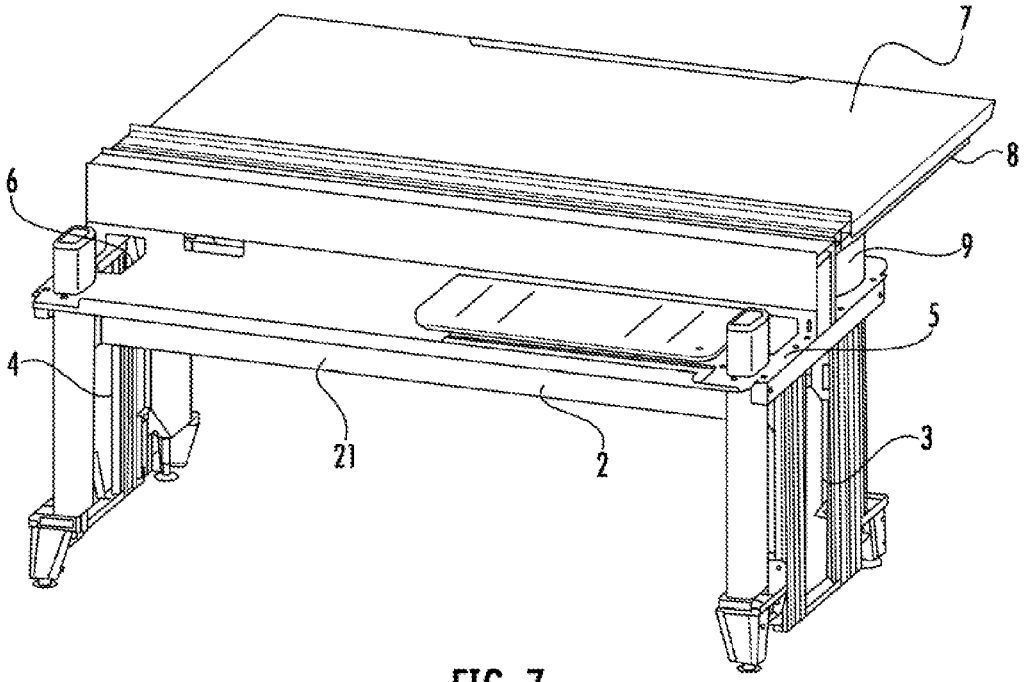
FIG. 7 shows a perspective view of the desk of FIG. 4 with the main support beam raised.

Referring to FIG. 7, the trading desk 1 is shown with the main beam structure 2 in a raised position. Although it is important for this invention that the main beam structure 2 can be positioned at a low level in order to co-operate with the trolley 10 as described above and to allow computers to be positioned beneath the desktop 7 while still allowing it to be set as low as 650 mm from the floor, in this preferred embodiment, the main beam structure may be raised. In the raised position shown in FIG. 7, a few small computers could still be laid horizontally on top of the main beam structure 2, for example on a platform carried by the main beam structure 2, but much more open space would be left underneath the trading desk 1. Alternatively, with the main beam structure 2 raised, smaller computers could be positioned on trolleys beneath the main support beams 21, 22.

Figure 8:
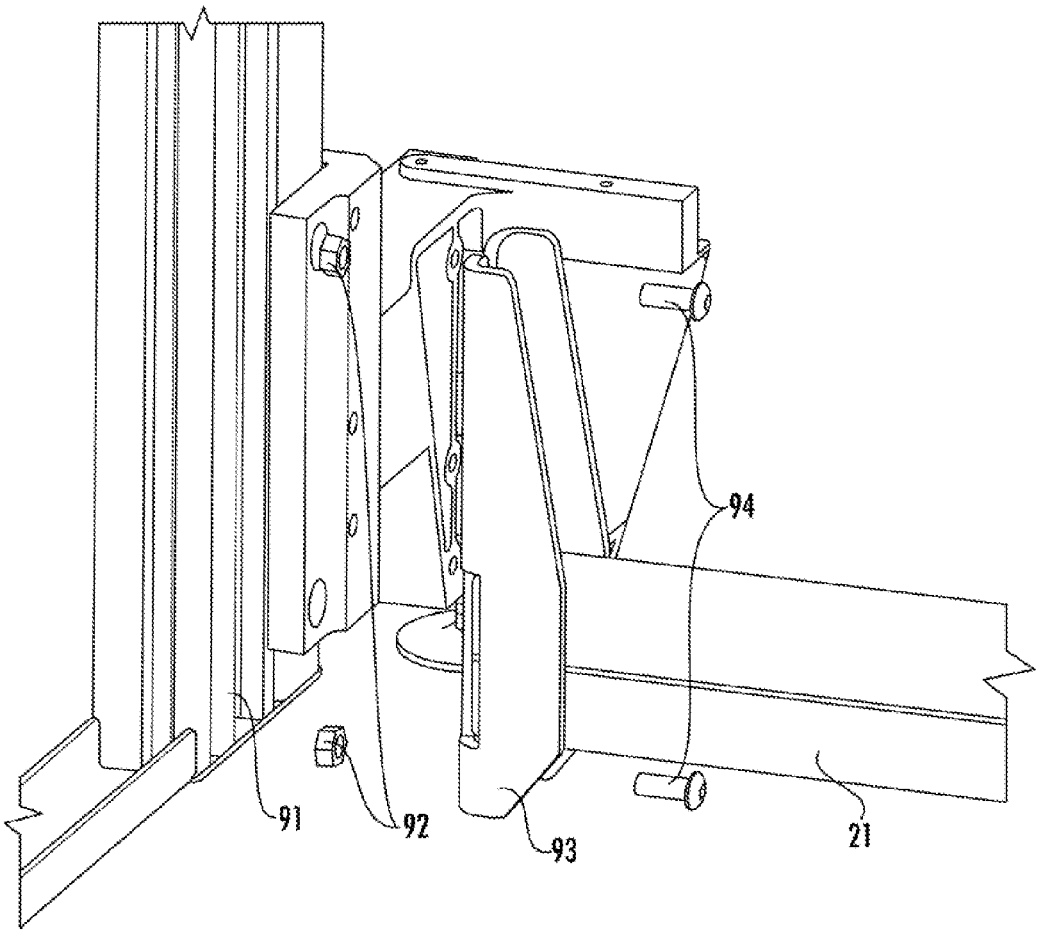
FIG. 8 shows an enlarged exploded view of the connection between the main support beam and the end frame of the desk of FIGS. 4 and 8.

FIG. 8 shows in more detail how the first main support beam 21 is attached to the second end frame 4 (the second main support beam 22 would be connected to the second end frame 4 in the same way, and the other ends of the first main support beam 21 and second main support beam 22 would be connected in the same way to the first end frame). It can be seen that the second end frame 4 is formed with extrusions in the vertical strut 41 defining a vertical re-entrant groove 91. Nuts 92 (in this case two nuts 92) are inserted into the cavity of the re-entrant groove 91, and oriented such that they cannot exit through the mouth of the re-entrant groove 91 (special nuts may be used which are provided with tabs so that they can enter in one orientation but cannot exit once tightened, or alternatively, ordinary nuts 92 as shown in FIG. 8 can be used, threaded into the re-entrant groove 91, from one of its ends.

The first main support beam 21 is provided with a vertically extending flange 93 at each of its ends. The flange 93 extends upwards above the end of the support beam 21 and downwards below it and is provided with holes (not shown) through which bolts 94 may be threaded. The holes of the flange 93 are lined up with the nuts 92, then corresponding bolts 94 are inserted through the holes into the mouth of the re-entrant groove 91 and are screwed into the nuts 92. This screwing action pulls the nuts 92 against the lips of the re-entrant groove 91, sandwiching the lips between the nuts 92 and the flange 93. While loosely fastened the main support beam 21 may be raised and lowered, but when the bolts 94 are tightened, the main support beam 21 will be held in place.

Figure 9:
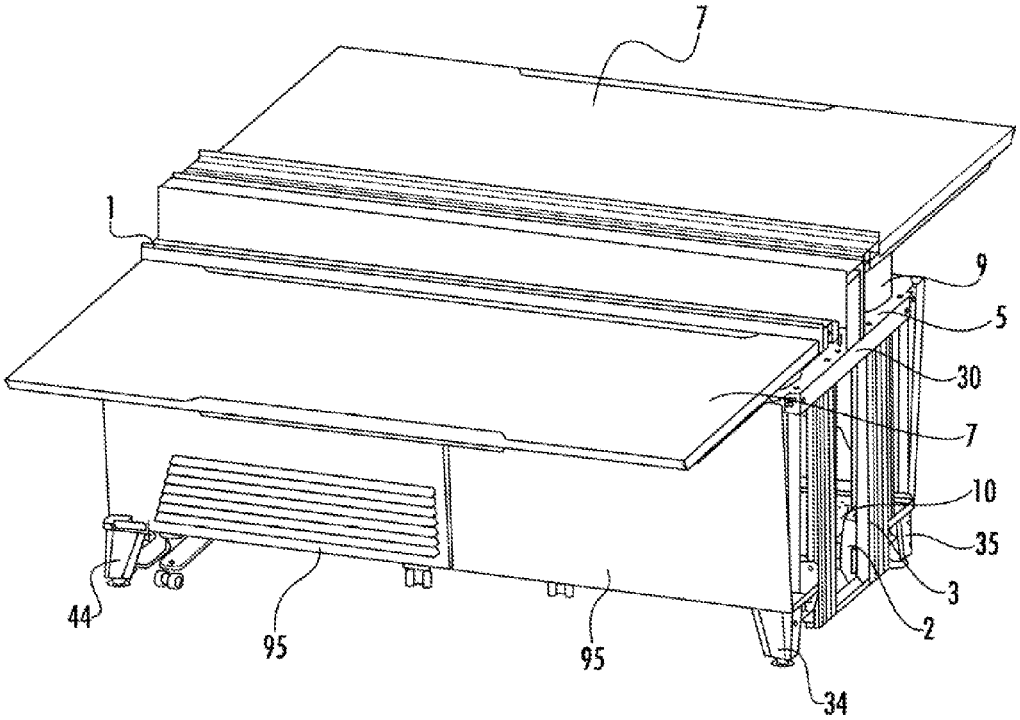
FIG. 9 shows a perspective view of a fully assembled trading desk according to the present invention.
Figure 10:
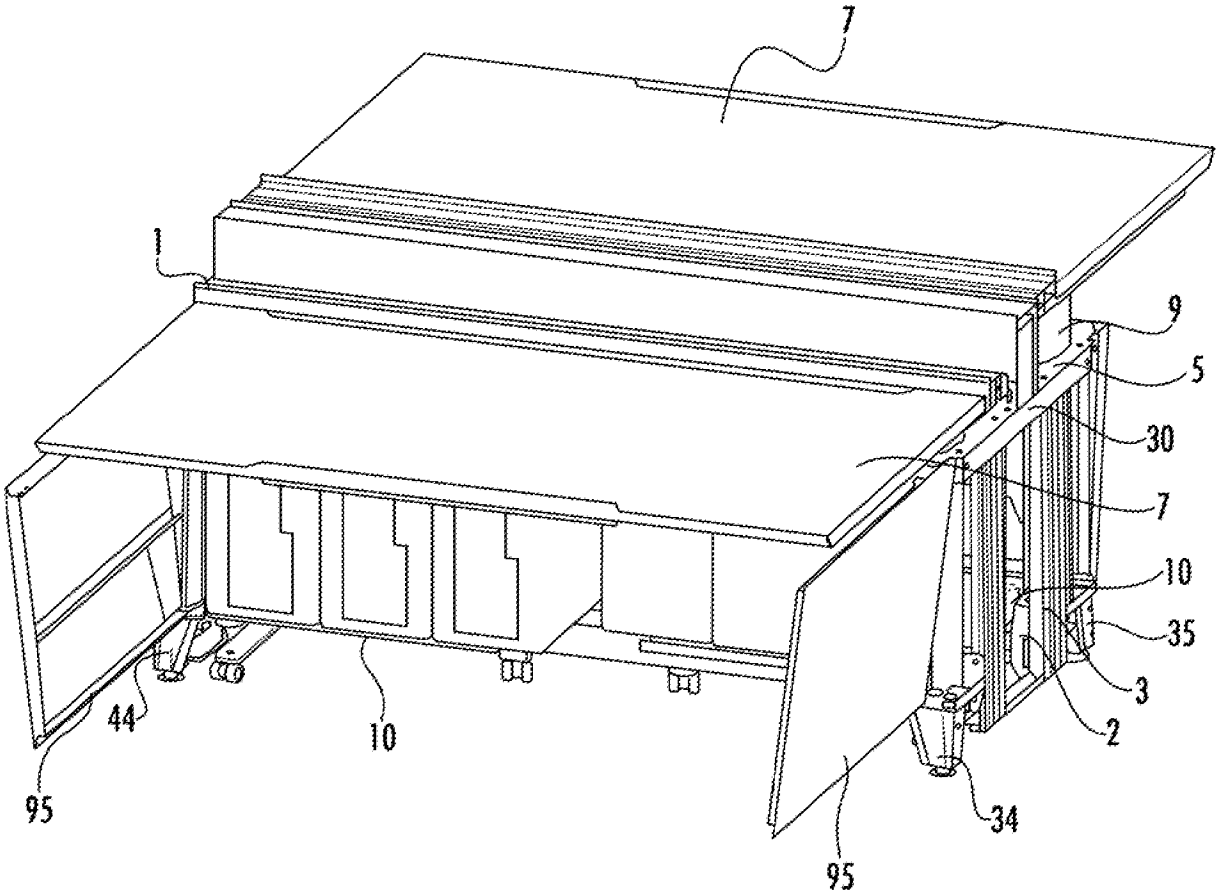
FIG. 10 shows a perspective view of the trading desk of FIG. 9 with its doors open.

Finally, in FIGS. 9 and 10 the complete trading desk 1 is shown, including desktops 7 on both sides, two trolleys 10 installed, and doors 95 closing off the space in which the computers (shown in FIG. 10) are located on their platforms. It can be seen that the doors 95 are hinged at the edges of the end frames 3, 4 and extend between the legs 34, 35, 44, 45 and a respective end of a bar 30, 40 located above the respective foot 34, 35, 44, 45. The doors are hinged such that their lower ends are positioned adjacent the end of a platform 11 of a trolley 10, approximately 120 mm above the base of the trading desk 1, such that a user's feet can be placed under the bottom of the door 95, beneath the platform 11. The doors extend outwardly away from the platform, so that the top is closer to the front of the desktop 7. Accordingly, the hinge at the top of the door, attached to the bar 30, 40 allows the top of the door to sit further away from the vertical struts 31, 32, 41, 42 than the bottom of the door. This means that even though the size of the platforms are made to closely correspond to the size of the computers mounted thereon, in order to avoid unnecessary wastage of space, a cavity is provided behind the sloping cabinet doors which can be used to store cabling etc. This cavity, being larger at the top of the doors is in a region which should not interfere with the legs of even a very tall user.

FIGS. 9 and 10 are also useful in showing one desktop 7 at the lowest height setting, in which the bottom of the desktop 7 is virtually coplanar with the top of the tray 5 that it sits above. The other desktop 7 is set at a more typical height for, about 100 mm higher.

It will be appreciated that various modifications can be made to the preferred embodiment disclosed above, and that the scope of the invention is defined by the appended claims. For example, while the movable nature of the main beam structure has just been discussed, it is of primary importance that the main support beam can be positioned low down relative to the frame, rather than in the usual position that plinth beams are found. Accordingly, instead of the re-entrant groove structure, various other means of releasable, or even permanent attachment could be provided to attach the main support beams to the lower part of the end frames, preferably attached to a part of the end frame that will be no more than 120 mm above the floor in use.

Likewise, while the preferred embodiment described above has end frames which include struts and have separate feet, but the feet could be provided on the ends of legs for example. Furthermore, while the example above has two main support beams, one extending laterally between each of the two struts that each end frame is provided with, a single main support beam could extend between the end frames, for example connected to a brace between struts. Indeed a desk could be provided in which each end frame has only one strut. Moreover, while the trading desk described above provides for two desktops 7 to be situated opposite each other, trading desks according to this invention, but with only one desktop would be useful, for example, where a row of desks is to be situated against a wall.

Those skilled in the art, could also construct alternative supports for the trolley, for example with extra links between the upper and lower webs.

The invention claimed is:

1. A desk comprising:

a main support beam and a base;

an upper surface of the main support beam being situated no more than 120 mm above the base of the desk;

a first end frame and an opposite second end frame each extending upwards from the base, and wherein the main support beam extends laterally between the first and second end frames for permitting vertical movement of the main support beam along the first and second end frames;

at least one desktop surface;

a slatted surface that is structured and disposed for receipt of at least one arm for supporting a monitor, and the slatted surface being sized and configured for permitting passage of heat therethrough; and a trolley for supporting computers, the trolley including a platform and a support, wherein the support defines a channel arranged to receive the main support beam on the frame.

2. A desk according to claim 1 wherein the desk is a trading desk.

3. A desk according to claim 1 wherein the channel is defined by a U-shaped support.

4. A desk according to claim 1 wherein the channel is defined by an H shaped support.

5. A desk according to claim 1 comprising a plurality of supports at least one of which is U-shaped.

6. A desk according to claim 1 comprising a plurality of supports, at least one of which is H-shaped.

7. A desk according to claim 1 having casters depending from the support.

8. A desk according to claim 1 wherein the at least one desktop surface comprises a first and a second oppositely disposed desktop surfaces.

9. A frame for a trading desk comprising:

a first end frame and an opposite second end frame each extending vertically;

a main support beam extending laterally between the first and second end frames for permitting vertical movement of the main support beam along the first and second end frames and support thereon;

a slatted surface that is structured and disposed for receipt of at least one arm for supporting a monitor, and the slatted surface being sized and configured for permitting passage of heat therethrough; and at least one sloping door hingedly connected to one of said end frames and sloping outwardly from their bottom to their top.

10. A frame according to claim 9 wherein the end frames comprise panels or struts which extend vertically in use, and which are provided with feet; wherein in use the main support beam extends between the lower part of the panels or struts.

11. A frame according to claim 9 wherein the end frames comprise legs.

12. A frame according to claim 11 wherein each end frame comprises a plurality of legs, with a brace extending between the lower parts of the legs.

13. A frame according to claim 9, further comprising a tray adapted to support cabling below a desktop.

* * * * *